US007603824B1

(12) United States Patent
Hartanto

(10) Patent No.: US 7,603,824 B1
(45) Date of Patent: Oct. 20, 2009

(54) FLOORING CONSTRUCTION

(75) Inventor: Budi Hartanto, Pasuruan (ID)

(73) Assignee: Pamasia, Inc., Madison, AL (US)

( * ) Notice: Subject to any disclaimer, the term of this patent is extended or adjusted under 35 U.S.C. 154(b) by 337 days.

(21) Appl. No.: 11/353,895

(22) Filed: Feb. 14, 2006

(51) Int. Cl.
*E04F 15/02* (2006.01)
*E04F 15/04* (2006.01)
*E04F 15/16* (2006.01)

(52) U.S. Cl. ..... 52/384; 52/390; 52/385; 52/578; 52/309.4; 52/309.8

(58) Field of Classification Search ..... 52/403.1, 52/592.1, 591.4, 384–392, 309.1, 309.4, 52/309.8, 578, 581; 428/192, 40.1, 40.5, 428/41.7, 42.1–42.3, 43–44, 50, 352, 347–348, 428/194; 472/92
See application file for complete search history.

(56) References Cited

U.S. PATENT DOCUMENTS

| | | | | | |
|---|---|---|---|---|---|
| 1,465,383 | A | * | 8/1923 | Walsh et al. | 428/106 |
| 1,660,480 | A | * | 2/1928 | Daniels | 52/390 |
| 2,037,259 | A | * | 4/1936 | Murphy et al. | 52/313 |
| 2,894,292 | A | * | 7/1959 | Gramelspacher | 52/474 |
| 3,016,316 | A | * | 1/1962 | Olson | 52/592.1 |
| 3,365,850 | A | * | 1/1968 | Marino | 52/309.3 |
| 3,579,941 | A | * | 5/1971 | Tibbals | 52/384 |
| 3,686,061 | A | * | 8/1972 | Brown et al. | 428/56 |
| 3,902,293 | A | | 9/1975 | Witt et al. | |
| 3,988,187 | A | | 10/1976 | Witt et al. | |
| 4,242,390 | A | | 12/1980 | Nemeth | |
| 4,471,012 | A | * | 9/1984 | Maxwell | 428/106 |
| 4,698,249 | A | | 10/1987 | Brown | |
| 4,803,112 | A | | 2/1989 | Kakimoto et al. | |
| 4,923,034 | A | | 5/1990 | Okuzawa et al. | |
| 5,103,614 | A | | 4/1992 | Kawaguchi et al. | |
| 5,109,898 | A | * | 5/1992 | Schacht | 144/350 |
| 5,441,786 | A | | 8/1995 | Manassa | |
| 5,830,549 | A | * | 11/1998 | Sweet et al. | 428/40.1 |
| 5,968,625 | A | * | 10/1999 | Hudson | 428/54 |
| 6,021,615 | A | * | 2/2000 | Brown | 52/392 |
| 6,122,873 | A | | 9/2000 | Randjelovic | |
| 6,751,917 | B2 | * | 6/2004 | Mao | 52/392 |
| 6,986,229 | B2 | * | 1/2006 | Collison et al. | 52/384 |
| 2002/0100231 | A1 | * | 8/2002 | Miller et al. | 52/177 |
| 2005/0208255 | A1 | | 9/2005 | Pervan | |

FOREIGN PATENT DOCUMENTS

| | | | |
|---|---|---|---|
| CA | 2434248 AL | * | 1/2004 |
| JP | 5-248075 | | 9/1993 |
| JP | 6-146556 | | 5/1994 |

* cited by examiner

*Primary Examiner*—Jeanette E. Chapman
(74) *Attorney, Agent, or Firm*—Pearne & Gordon LLP

(57) ABSTRACT

A composite panel for constructing an interior real wood finished floor comprising a rectangular planar unit having top, middle and bottom layers, the top layer being solid wood with a unidirectional grain parallel to opposite edges of the panel, the bottom layer being constructed of wood and having at least portions of its thickness with a grain running perpendicular to the unidirectional grain, the middle layer being an elastomeric material bonded to the top and bottom layers.

13 Claims, 2 Drawing Sheets

FLOORING CONSTRUCTION

BACKGROUND OF THE INVENTION

The invention relates to flooring and, in particular, to wood-based flooring tiles or planks.

PRIOR ART

The natural beauty and durability of real wood flooring are qualities that explain its continued use and popularity in interior construction. Traditionally, wood floors have been constructed with planks or parquet tiles. Various wood-based composite constructions have been commercially sold or proposed. These have taken the form, for example, of plywood, chipboard and particle board. It has also been proposed to assemble layers of wood or wood-based material and a layer of elastomeric material.

There remains a need for a natural wood look in a premium floor product that improves the sound-deadening capacity, comfort level of a person standing or ambulating on the floor and durability from impacts or concentrated loads over what can be obtained from traditional solid wood flooring.

SUMMARY OF THE INVENTION

The invention relates to a premium wood-based flooring tile or plank (collectively a panel) that affords the natural beauty and richness of real wood with improved performance qualities. The panel of the invention is a multilayer composite comprising wood top and bottom layers separated by an intermediate elastomeric layer. Preferably, the intermediate layer is a relatively compressible natural or synthetic foamed material adhered to both the top and bottom wood layers. More specifically, the top layer is preferably a solid high density wood that serves to give the panel its appearance and its wear surface. The bottom layer, ideally, is a low grade, low density, or soft wood-based plywood with the majority of its plies having their grain arranged to run crosswise to the grain direction of the top layer. The intermediate foam layer has negligible strength compared to the wood top and bottom layers, but is protected by such layers during shipping, handling, installation and service. Notably, the intermediate elastomeric layer requires no extra labor in the installation of the panel product. The intermediate foam layer, which can be relatively thin compared to the top and bottom layers, serves a plurality of functions. The intermediate layer acts as a cushion so that a person standing, walking, or even running on the panel is more comfortable compared to what would be experienced on conventional floor board construction. The intermediate layer serves to dampen noise and reduce sound transmission. Additionally, the intermediate layer absorbs impact loads and distributes concentrated loads imposed on the top layer. Still further, the intermediate layer isolates the top and bottom layer from shear loads so that differential expansion or contraction of the top and bottom layers does not result in delamination and/or cupping of the layers. This can be particularly beneficial when the bottom layer is adhered to a sub-floor or concrete slab. As still another attribute, the intermediate layer serves as a thermal break between the top and bottom layers.

In its preferred form, the panel has a tongue and groove geometry machined in and confined to the top layer. This arrangement takes full advantage of the inherent integrity and toughness of the dense top layer. By eliminating contributions to the tongue and groove joint from the intermediate and bottom layers, a tight gap-free joint at the visible surface is more readily obtained. Additionally, the tongue and groove feature of the panel enables abutting panels to transfer compressive loads from one panel to the adjacent panel thereby lessening peak stresses on a particular panel.

DESCRIPTION OF THE PREFERRED EMBODIMENT

Figure 1:
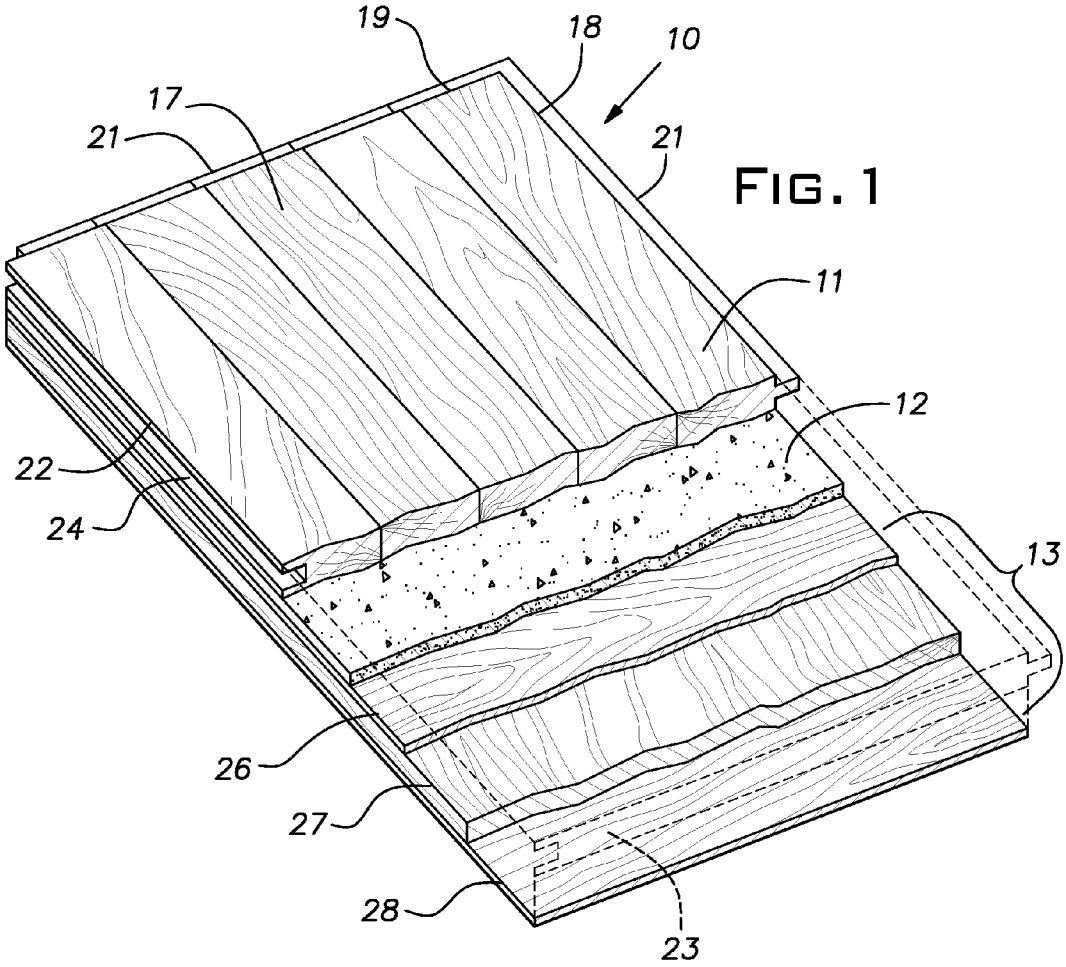
FIG. 1 is a perspective view of a panel constructed in accordance with the invention with portions broken away to reveal details of its construction.

A floor panel 10 constructed in accordance with the invention can take the form of a rectangular tile or a plank, it being understood that square is included in the term rectangular. The illustrated panel 10 is a tile having, by way of example but not limitation, nominal thickness of 15.2 mm and planar face dimensions of 150 mm in width and 300 mm in length. The panel 10 comprises top, intermediate and bottom layers 11, 12 and 13, respectively. The top layer 11 comprises solid wood with its grain running in a direction parallel to the length of the panel, assuming it is rectangular. The top layer 11 can be built-up of a plurality of bar-like strips 14 glued together at their abutting edges 16 in parallel vertical planes. Ideally, the wood forming the top layer 11 is a premium grade of high density or hard wood such as oak or maple. An upper surface 17 of the top layer 11, desirably, is prefinished with a stain or colorant and/or protective coating such as polyurethane or acrylic lacquer or the like. Two intersecting edges 18, 19 of the top layer 11 are formed or machined with tongues 21 and the remaining two edges 22, 23 are formed with grooves 24 complementary to the tongues, as is customary.

Figure 2:
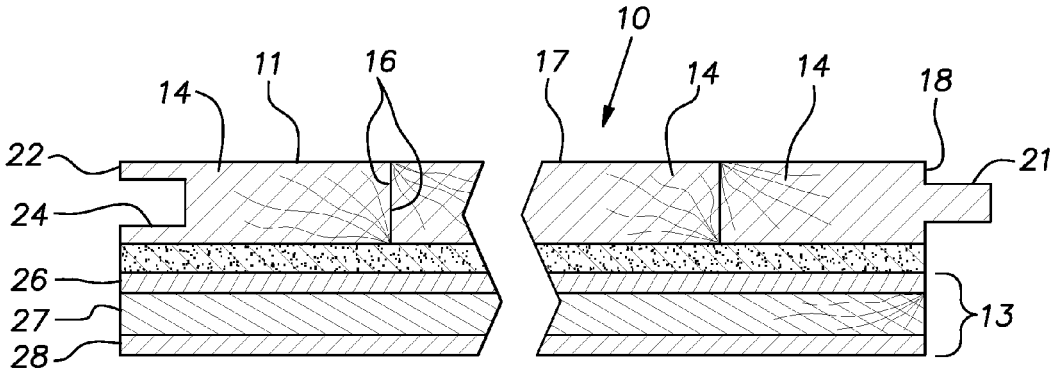
FIG. 2 is an end view, partially broken away, of the floor panel of FIG. 1 on an enlarged scale.

The top or upper layer 11, disregarding the extension of the tongues 21 determines the nominal face size of the panel 10. Inspection of FIG. 2 shows that the intermediate and bottom layers 12, 13 are slightly smaller, in plan view, than the top layer 11 so that the top layer projects slightly beyond the intermediate and bottom layers around the full periphery of the panel 10 to assure that the panel will mate with identical panels and form tight joints at the top layer 11.

The lower layer 13 is a plywood construction of low density soft wood such as, for example, lauan mahogany. In the illustrated example, the lower layer 13 comprises three wood plies 26-28 adhered uniformly across their abutting surfaces with a suitable glue or adhesive. As is customary, the grains of abutting plies 26, 27 and 27, 28 are arranged perpendicularly to one another. The wood grain direction of the outer plies 26, 28 (the upper and lower plies) largely determines the bending stiffness of the lower layer 13 and are arranged perpendicularly to the grain of the upper layer 11. This enables the lower or bottom layer 13 to reinforce and stiffen the upper layer 11 against any bending about an axis parallel to the grain direction of the upper layer 11.

The intermediate layer 12 is preferably foamed elastomeric material either of natural or synthetic origin such as natural rubber or a polymeric resin material such as polyvinylchloride, polyethylene, urethane, or the like. The elastomeric material of the intermediate layer 12 is ideally relatively soft and characterized with low stiffness, elasticity, and moderate to high damping capacity. The intermediate layer 12 is permanently uniformly bonded to the top and bottom layers 11, 13. The elastomeric material is preferably made with a foaming ratio of about at least 2 up to about 4.5. If desired, the intermediate layer 12 can be discontinuous or patterned such that there are areas between the upper and lower layers 11, 13 devoid of the intermediate layer material.

The panel 10 can be bonded to a sub-floor with a suitable adhesive applied first to the subfloor on site or to the lower face of the bottom layer 13 during manufacture or on site. A plurality of panels 10 are assembled together to make up the total floor surface with the top layer 11 constituting the appearance and wear surface. The tongue and grooves 21, 24 assure a smooth floor surface will be produced across joints of abutting panels. The intermediate layer 12 and bottom layer 13, as mentioned, are spaced slightly inward of the perimeter of the top layer 11 (apart from the tongues 21) to assure that the joint between the butting panels 10 is formed by the top or upper layer and is tight. The tongue and groove joint between the panels 10 beneficially allows compressive loads on one panel to be partially transferred and, therefore, shared by an abutting panel. The compressibility of the foamed intermediate layer 12 cushions a person's footsteps on a floor surface made up of the panels 10 making it more comfortable than a solid wood floor without the intermediate layer.

Figure 3:
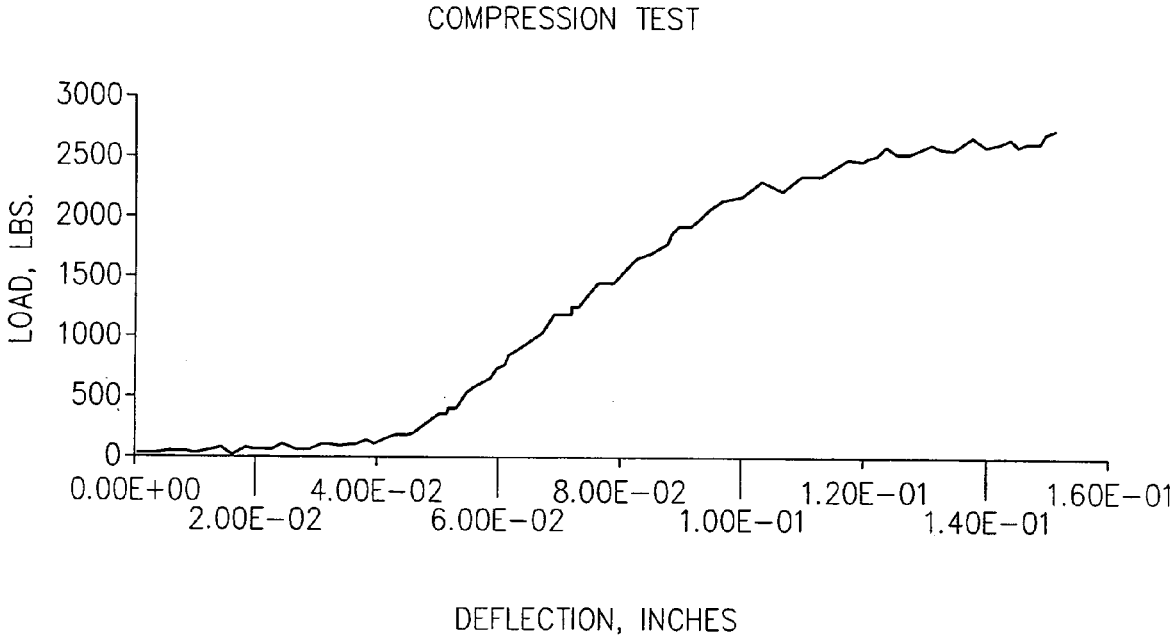
FIG. 3 is a graph of load vs. deflection of a sample of one example of a panel constructed in accordance with the invention.

A sample of the flooring panel 10 was cut into 1 inch×1 inch squares and loaded in a compression testing machine. A typical force vs. deflection curve is shown in FIG. 3. The initial portion of the curve of FIG. 3 (deflections from 0 to 0.04 inches) is dominated by the compression of the soft central layer 12. The central region of the curve (deflections from 0.04 to 0.1 inches) is associated with the elastic compression of the compacted intermediate layer 12 as well as the wood layers 11, 13. Over 0.1 inch deflections, non-linear deformation in the wood 11, 13 occurs. The curve of FIG. 3 illustrates the desirable relatively soft, compliant nature of the intermediate layer 12. While the intermediate layer 12 is desirably relatively soft, it is protected from physical damage by the top and bottom layers 11 and 13.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A composite panel for constructing an interior real wood finished floor comprising a rectangular planar unit having top, middle and bottom layers, the top layer being solid wood with a unidirectional grain parallel to opposite edges of the panel, the bottom layer being constructed of wood and having at least portions of its thickness with a grain running perpendicular to said unidirectional grain, the middle layer being an elastomeric material in a compressible foam state bonded to said top and bottom layers, said bottom layer being plywood having at least two plies arranged with their grains running perpendicular to said unidirectional grain, the middle foam layer exhibiting a cushion effect that is characterized by a generally linear force versus deflection curve up to about 0.4 inch deflection.

2. A composite panel as set forth in claim 1, wherein said top layer is made of strips of a common thickness and being butted together along vertical planes parallel to said unidirectional grain.

3. A composite panel as set forth in claim 1, including tongues and grooves at four sides of a periphery of the panel.

4. A composite panel as set forth in claim 3, wherein said tongues and grooves are formed in said top layer.

5. A floor panel with four edges forming its periphery for assembly with like panels to form an interior floor surface comprising a planar rectangular unit with a top, intermediate and bottom layer, the top and bottom layers being formed of wood and the intermediate layer being an elastomeric compressible foam material bonded to both the top and bottom layer, the top layer having a pair of adjacent tongues on two adjacent edges and a pair of grooves on two adjacent edges of its periphery, the foam material exhibiting a cushion effect that is characterized by a generally linear force versus deflection curve up to about 0.04 inch deflection.

6. A floor panel as set forth in claim 5, wherein the intermediate and bottom layers are smaller in plan view than a periphery of the top layer.

7. A floor panel as set forth in claim 5, wherein the top layer is thicker than the combined thickness of the middle layer and bottom layer.

8. A floor panel as set forth in claim 5, wherein the top layer is solid wood.

9. A floor panel as set forth in claim 8, wherein the top layer has a wood grain aligned in a first direction.

10. A floor panel as set forth in claim 9, wherein the top layer is comprised of strips of wood glued together along vertical planes parallel to the first direction of the wood grain of the top layer.

11. A floor panel as set forth in claim 10, wherein the bottom layer has a wood grain orientation perpendicular to the first grain direction.

12. A floor panel as set forth in claim 11, wherein the bottom layer is plywood.

13. A floor panel as set forth in claim 12, wherein the bottom layer has three plies with two of said plies having their grain running perpendicular to said first grain direction.

* * * * *

UNITED STATES PATENT AND TRADEMARK OFFICE

CERTIFICATE OF CORRECTION

PATENT NO. : 7,603,824 B1
APPLICATION NO. : 11/353895
DATED : October 20, 2009
INVENTOR(S) : Budi Hartanto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 515 days.

Signed and Sealed this

Fifth Day of October, 2010

David J. Kappos

David J. Kappos
*Director of the United States Patent and Trademark Office*